United States Patent [19]

McGlashan

[11] Patent Number: 4,654,615

[45] Date of Patent: Mar. 31, 1987

[54] RASTER DISTORTION CORRECTOR FOR CATHODE RAY TUBES

[75] Inventor: Kenneth W. McGlashan, Indianapolis, Ind.

[73] Assignee: RCA Corporation, Princeton, N.J.

[21] Appl. No.: 813,758

[22] Filed: Dec. 27, 1985

[51] Int. Cl.[4] ..... H01F 3/12

[52] U.S. Cl. ..... 335/211; 335/212; 313/427

[58] Field of Search ..... 335/210, 212, 211; 313/421, 426, 427, 428, 429, 430

[56] References Cited

U.S. PATENT DOCUMENTS 4,357,586 11/1982 Barkow et al. ..... 335/211
4,386,331 5/1983 Kohzuki et al. ..... 335/211
4,433,268 2/1984 Arisato ..... 335/211 X

*Primary Examiner*—George Harris
*Attorney, Agent, or Firm*—Paul J. Rasmussen; Joseph Laks; Scott J. Stevens

[57] ABSTRACT

A raster distortion corrector for a cathode ray tube includes magnetically permeable corrector pieces that are located on opposite sides of the deflection yoke. A part of each corrector piece is located within the external field of the vertical deflection coils and presents a low reluctance path to the external field flux. The flux is directed via a flux channelling arm of each corrector piece to a field shaper that causes a distortion correcting field to be formed between the corrector pieces. The flux channelling arms are formed and located so that there is no significant interaction of the corrector pieces with the horizontal deflection field.

6 Claims, 6 Drawing Figures

RASTER DISTORTION CORRECTOR FOR CATHODE RAY TUBES

This invention relates to raster distortion correction for a cathode ray tube of a video display apparatus and, in particular, to correction of raster distortion by the modification of electromagnetic fields.

The cathode ray tube (CRT) of a video display apparatus, such as a color television receiver or a computer monitor, produces three electron beams which are caused to strike particular phosphor spots or stripes on a display screen of the CRT. The phosphor elements, when energized by the electron beams, emit light of a particular color. The CRT is designed so that each electron beam strikes only one particular color-producing phosphor type.

The shape and contour of the front panel of the CRT causes the electron beams to traverse a greater distance to the corners of the display screen than to the screen sides. This causes the raster scanned by the beam or beams to be pincushion shaped, i.e., the sides, and top and bottom of the raster being bowed inward with respect to the corners.

Correction of this pincushion distortion may be accomplished by electronic circuits that change the deflection current in a time-varying manner in order to cause the electron beam deflection to compensate the raster distortion. For example, the horizontal deflection current can be changed at the vertical deflection rate in order to correct pincushion distortion at the sides of the screen. These correction circuits, however, increase the cost and complexity of the video display apparatus and may increase power dissipation.

The video display apparatus typically includes a self-converging display system that incorporates a CRT having an electron gun assembly that produces three horizontally aligned electron beams, and a deflection yoke that converges the electron beams on the CRT display screen without the need for additional convergence circuits. In order to accomplish this, the deflection yoke incorporates horizontal and vertical deflection coils which have winding distributions that produce deflection fields having nonuniform field gradients in the electron beam deflection region. It is known that proper beam convergence requires the horizontal deflection coils to produce a pincushion shaped field (as viewed along the CRT longitudinal or Z-axis) and the vertical deflection coils to produce a barrel shaped field. It is also known that causing localized changes in the deflection field nonuniformity along the CRT longitudinal axis may aid in the correction of some forms of raster distortion or electron beam landing errors, such as the previously described pincushion raster distortion.

U.S. Pat. No. 4,257,023, issued Mar. 17, 1981, in the name of N. Kamijo, and entitled, "DEFLECTING DEVICE FOR CATHODE-RAY TUBE", discloses a magnetically permeable structure that is mounted near the front of the yoke in order to provide side pincushion raster distortion correction. The disclosed structure provides a low reluctance path for external field flux from the vertical deflection coils. The external flux is conducted to feet-like members at the front of the yoke. A pincushion shaped field is formed between the feet-like members which acts to correct side pincushion distortion.

The previously described correction is provided, as stated, by the structure which modifies the distribution of the external electromagnetic field produced by the vertical or field-rate deflection coils. Interaction of the magnetically permeable correction structure with the horizontal or line-rate deflection field may occur, however, with the result that line-rate energy is dissipated in the correction structure, necessitating a compensating increase in line-rate energy provided by the horizontal deflection circuit. This results in an overall lowering of the efficiency of the deflection yoke and deflection circuitry.

Optimum performance of a field shaping or modifying structure therefore requires sufficient interaction with the field to be modified while maintaining as little interaction as possible with the field that is not to be modified.

In accordance with an aspect of the invention, a deflection yoke for a cathode ray tube of a video apparatus comprises a line-rate deflection winding producing an electromagnetic field. A field-rate deflection winding produces a beam deflecting field and an external field. First and second magnetically permeable members are located on opposite sides of the yoke and include a flux collecting part located within the external field, a field shaping part, and a flux channelling arm connecting the flux collecting and field shaping parts. The flux channelling arm is oriented to present substantially no frontal area to the flux lines of the line-rate field. An electromagnetic field is formed between the field shaping parts that contributes to the beam deflecting field produced by the field-rate winding.

In the accompanying drawing.

Figure 1:
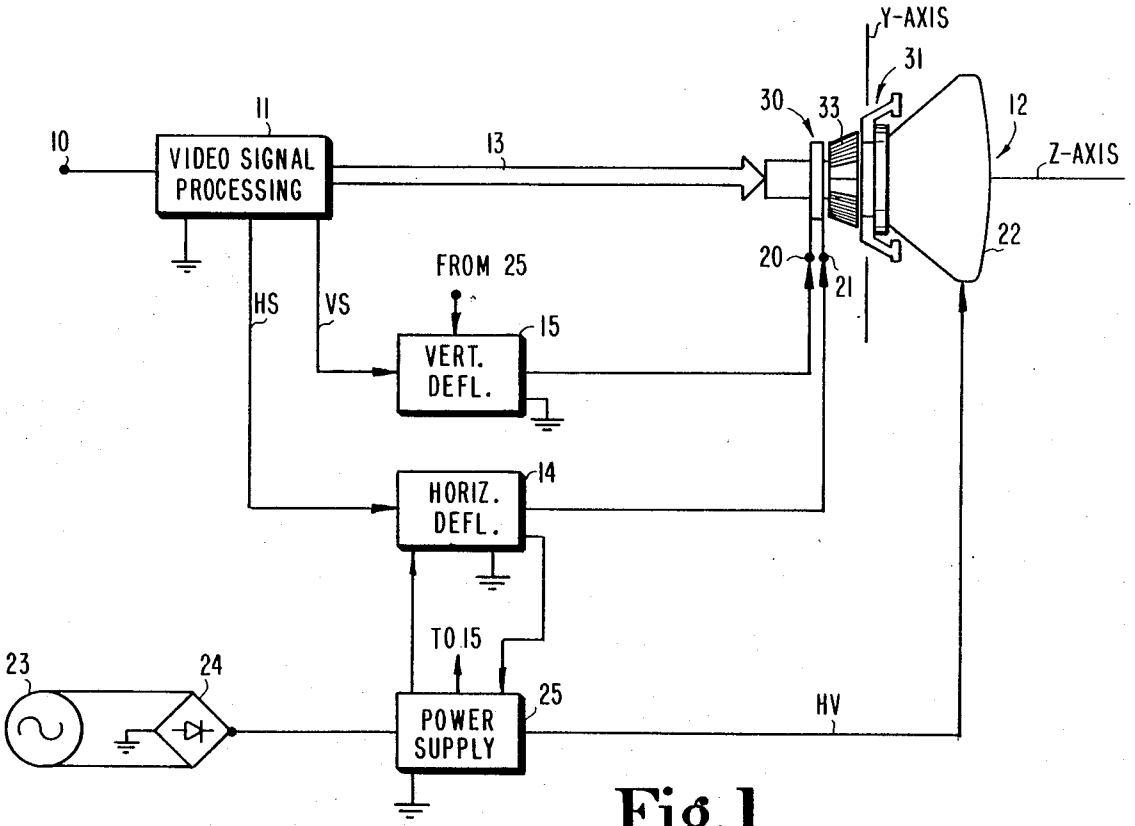
FIG. 1 is a schematic and block diagram of a video apparatus that includes a deflection yoke embodying the invention.

FIG. 1 illustrates a video display apparatus in which a video signal at a terminal 10 is applied to a video processing circuit 11. The video signal is provided from a source of video signals (not shown), such as a television receiver tuner or an external source, for example a video cassette recorder. The video signal processing circuit 11 generates the electron beam drive signals and applies them via a conductor 13 to the electron gun assembly (not shown) of a cathode ray tube 12 in order to modulate the intensity of the electron beam or beams produced by the electron gun assembly in accordance with the information of the video signal.

Video signal processing circuit 11 also produces horizontal, or line-rate, and vertical, or field-rate, synchronizing signals that are applied to horizontal deflection circuit 14 and vertical deflection circuit 15, respectively, along conductors designated HS and VS. Vertical deflection circuit 15 generates vertical deflection rate signals that are applied via a terminal 20 to the vertical or field-rate deflection coils 33 of deflection yoke 30, embodying the invention, located on CRT 12, in order to produce vertical deflection current in coils 33. Horizontal deflection circuit 14 generates horizontal deflection rate signals that are applied via a terminal 21 to the horizontal or line-rate deflection coils (not shown) of yoke 30, in order to produce horizontal deflection current. The horizontal and vertical deflection current flowing in yoke 30 produces electromagnetic fields that deflect or scan the electron beams to form a raster on the phosphor display screen 22 of CRT 12.

Power for the video apparatus is provided from an AC power source 23 which is connected to a rectifying circuit 24 which produces and applies an unregulated DC voltage to a power supply circuit 25. Power supply circuit 25, illustratively of the flyback type, includes regulating circuits which act to produce regulated voltage levels that are used to provide power to horizontal deflection circuit 14 and vertical deflection circuit 15, for example. Power supply 25 also supply a high voltage level of the order of 25 KV along a conductor HV to the high voltage or ultor terminal of CRT 12.

The raster scanned by deflection yoke 30 on display screen 22 exhibits distortion caused by the difference between the contour of the display screen 22 and the electron beam scanning radius. This causes the electron beams to be deflected a greater distance to the corners of the screen compared to the top, bottom and sides, with the resulting raster having an inwardly bowed, or pincushion shape. It is known from third order aberration theory that localized changes in the deflection fields and, in particular, changes in the field nonuniformity functions, may be utilized to effect correction of electron beam landing errors, including pincushion raster distortion.

Figure 2:
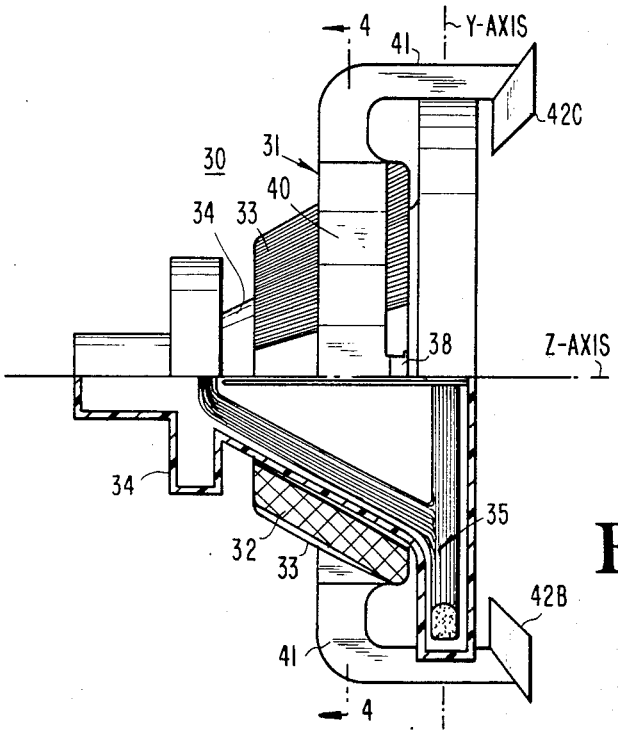
FIG. 2 is a side elevational view of the deflection yoke of FIG. 1, shown partially in cross-section, constructed in accordance with the present invention.

In accordance with an aspect of the present invention, FIG. 2 illustrates, in detail, deflection yoke 30 which advantageously incorporates a raster distortion corrector 31. Deflection yoke 30 comprises a magnetically permeable core 32 about which are toroidally wound the vertical or field-rate deflection coils 33. A plastic insulator and support 34 separates the vertical coils 33 and core 32 from the saddle-type horizontal or line-rate deflection coils 35.

Figure 4:
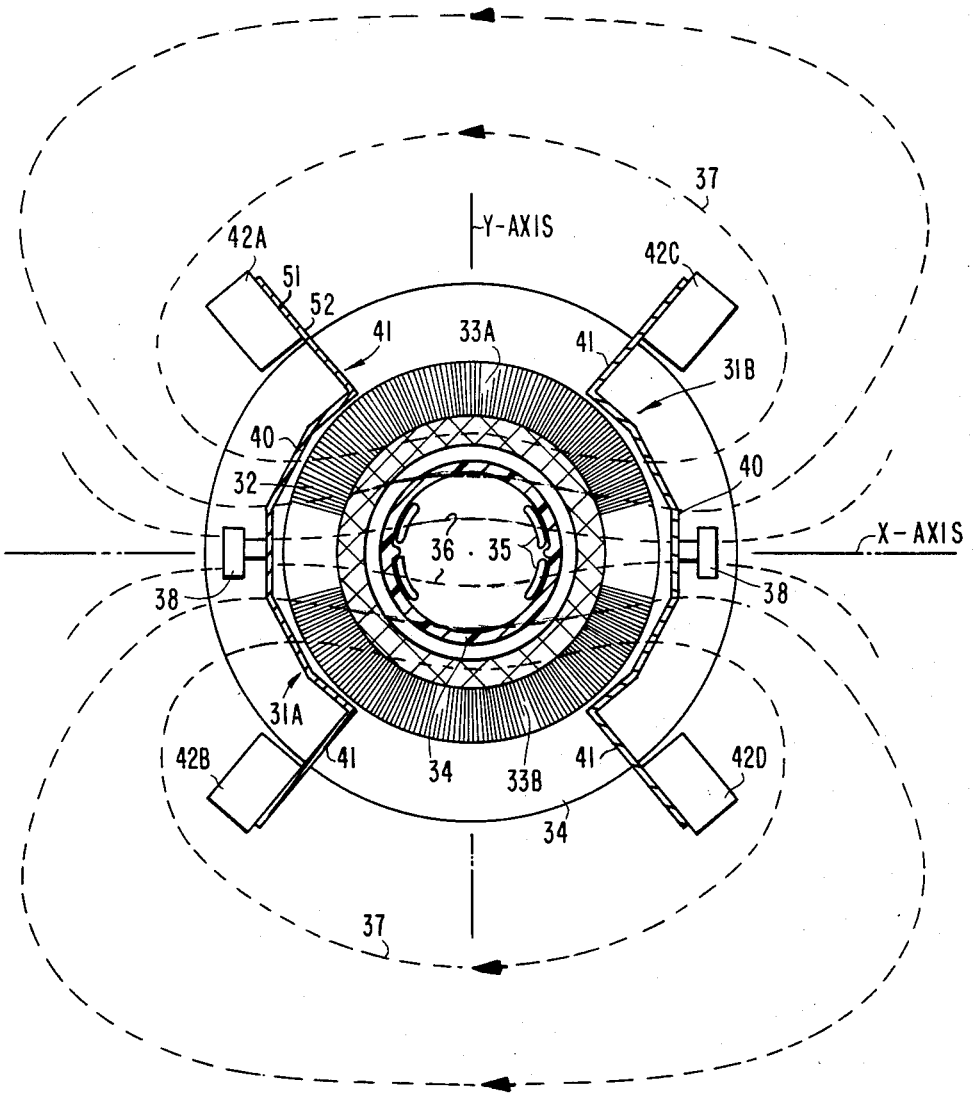
FIG. 4 is a rear elevational cross-sectional view of the deflection yoke shown in FIG. 2.

The deflection fields produced by vertical coils 33 and horizontal coils 35 occur predominantly between the respective coils in the vicinity of the electron beams of the cathode ray tube. The coils also generate fields external to the coils which do not contribute to electron beam deflection. As can be seen in FIG. 4, toroidally wound coils, in this case the vertical deflection coils 33, produce significant external fields 37. The predominant beam deflection components 36 produced by the vertical deflection coil 33 is formed between coils 33A and 33B of the vertical coils 33, and the external field 37 extends external to coils 33 and 32.

Figure 5:
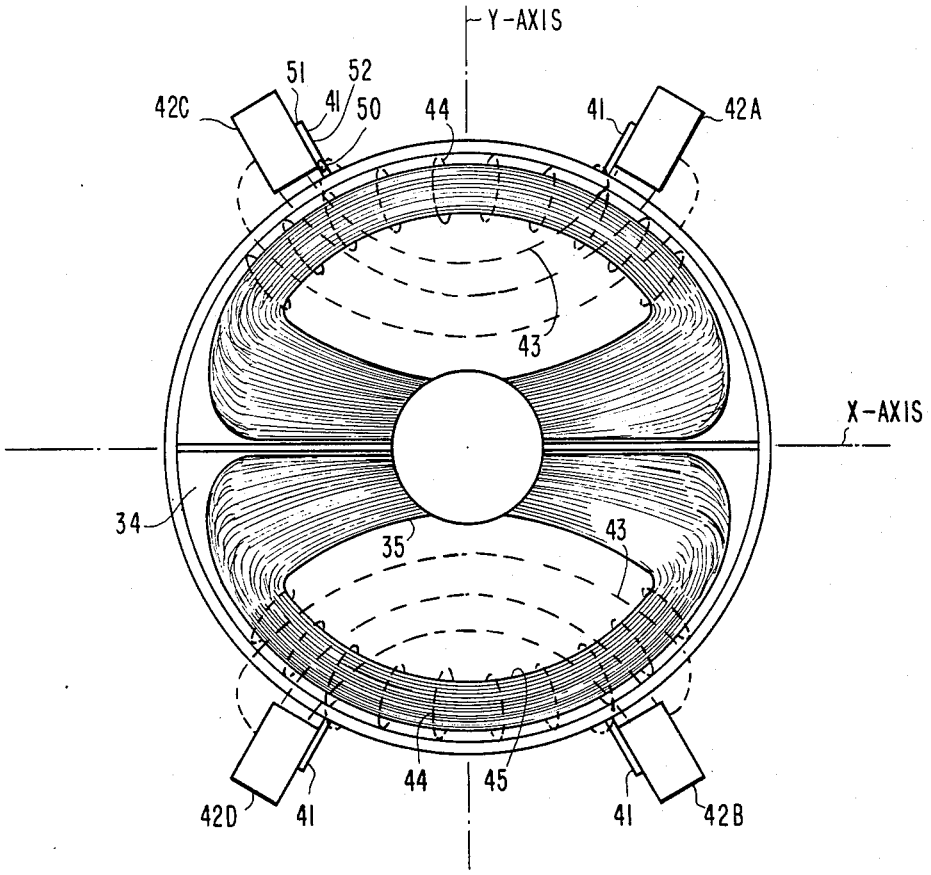
FIG. 5 is a front elevational view of the deflection yoke shown in FIG. 2.

In order to utilize the otherwise unutilized energy of external field 37, the novel arrangement of raster distortion corrector 31 is provided. Raster distortion corrector 31 comprises two corrector elements 31A and 31B each of which comprises a magnetically permeable flux collector portion 40, located within the external field 37 of the vertical deflection coils 33. The corrector elements 31A and 31B are illustratively mounted to insulator 34 via lugs 38. Flux collector portion 40 provides a lower reluctance path for the external field flux than the surrounding air and therefore flux from stray field 37 will enter flux collector 40. This external field flux will be distributed in corrector elements 31A and 31B such that flux will pass via flux channelling arms 41 of corrector 31A to field directing or shaping members 42A and 42B and via flux channelling arms 41 of corrector 31B to field directing members 42C and 42D. A resulting auxiliary electromagnetic field will be formed between field directing members 42A and 42C of corrector elements 31A and 31B, respectively, and between field directing members 42B and 42D. The shape and orientation of field directing members 42A–42D are determined so that the field formed between correctors 31A and 31B, as shown in FIG. 5 and designated 43, provides the desired raster distortion correction. In the embodiment shown in FIG. 5, the correction field 43 provides top and bottom or North-South, pincushion distortion correction. A different orientation and position of the field directing members may, with the field directing members of each corrector element being located closer to the deflection yoke X-axis for example, be utilized to provide East-West, or side, pincushion distortion correction.

Figure 6:
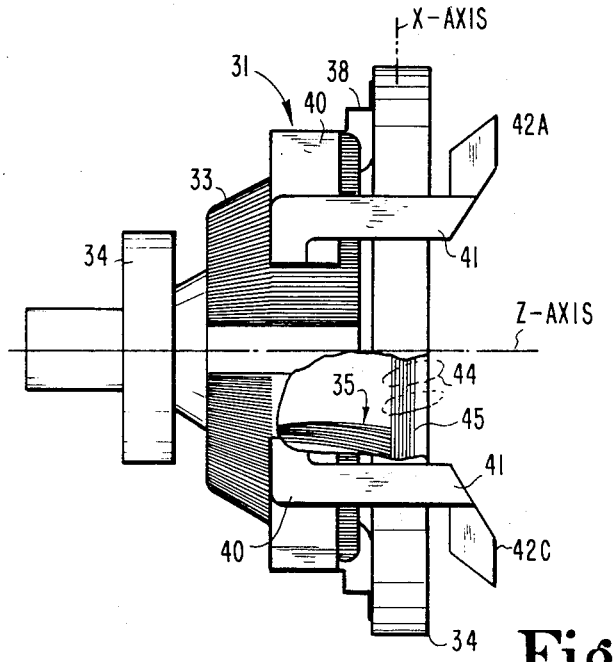
FIG. 6 is a top plan view, partially broken away, of the deflection yoke shown in FIG. 2.
Figure 3:
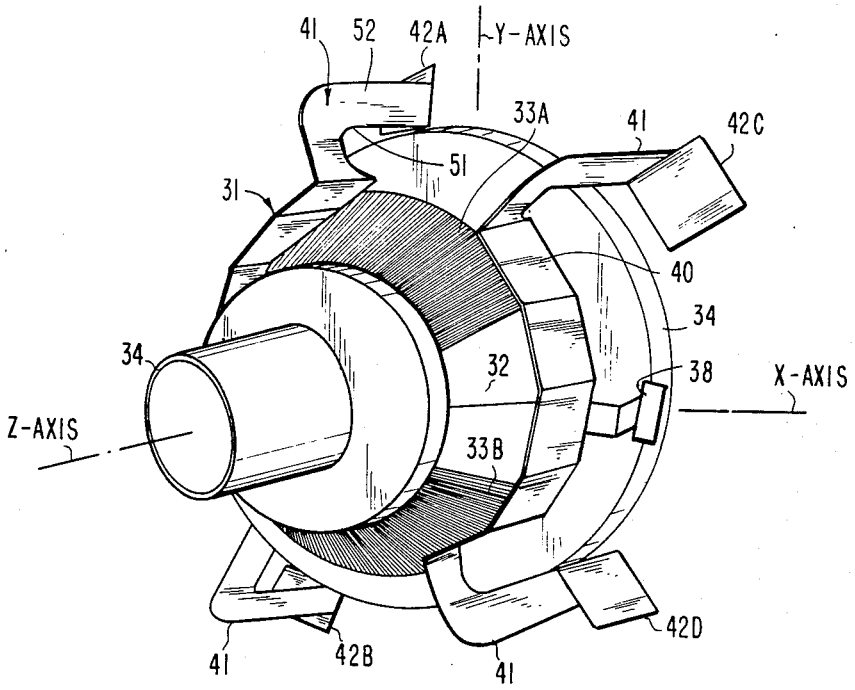
FIG. 3 is a perspective view of the deflection yoke shown in FIG. 2.

As can be seen in FIGS. 5 and 6, external field flux lines 44 circulate around the deflection current return end turns 45 of horizontal deflection coils 35 in a direction perpendicular to the wire path direction. If this external field flux 44 enters and interacts with raster distortion corrector 31, horizontal deflection energy will be dissipated as corrector 31 becomes heated due to resistive eddy current losses, thereby increasing the horizontal deflection circuit power requirements. The effective resistance losses of the horizontal deflection coil also increase, which increases the deflection linearity correction requirements. In order to prevent this undesirable interaction of the horizontal deflection field with distortion corrector 31, the novel arrangement of distortion corrector 31 has corrector elements 31A and 31B constructed to have flux channelling arms 41 of corrector elements 31A and 31B oriented on an edge 51 rather than a flat 52 so that as small a frontal area as possible is presented perpendicular to the direction of the flux 44 of the horizontal coil end turns. This novel construction of corrector elements 31A and 31B can be seen in FIG. 3. As a result, no significant amount of flux enters corrector elements 31A and 31B since the flux lines of horizontal end turn flux 44 enters edge 51 rather than flat 52 of flux channelling arm 41 and therefore essentially no horizontal deflection energy is lost via interaction with corrector 31. The eddy current loop 50, shown in FIG. 5, is therfore constrained to be small, with the result that energy loss is small. As can be seen in FIGS. 3, 4 and 5, the thickness dimensions of flux channelling arms 41 that define the frontal area that is perpendicular to the path of the horizontal coil end turn flux 44 are very small and do not intersect the flux path to any significant degree. The raster distortion corrector 31 therefore provides effective distortion or electron beam landing correction without adversely affecting the operation of the deflection yoke in any other manner.

What is claimed is:

1. A deflection yoke for a cathode ray tube of a video apparatus comprising:

a line-rate deflection winding producing an electromagnetic field;

a field-rate deflection winding producing an electron beam deflecting field and an external field; and first and second magnetically permeable field modifying members disposed on opposite sides of said deflection yoke for producing an auxiliary electron beam deflecting field, each of said members comprising:

a first flux collecting portion disposed within said external field;

a field shaping portion; and a flux channelling arm connecting said flux collecting portion and said field shaping portion, and oriented such that no significant frontal area is presented to the flux lines of said electromagnetic field of said line-rate deflection winding.

2. The arrangement defined in claim 1, wherein said field formed between said field shaping portions corrects pincushion distortion exhibited on said cathode ray tube.

3. The arrangement defined in claim 1, wherein the dimensions of said flux channelling arms that lie in a plane parallel to the flux path of said line-rate electromagnetic field are significantly greater than the dimensions of said flux channelling arms that lie in a plane perpendicular to said flux path of said line-rate electromagnetic field.

4. A deflection yoke for a cathode ray tube of a video apparatus comprising:

a line-rate deflection winding producing an electromagnetic field;

a field-rate deflection winding producing an electron beam deflecting field and an external field; and first and second magnetically permeable field modifying members disposed on opposite sides of said deflection yoke for producing an auxiliary electron beam deflecting field, each of said members comprising:

a first flux collecting portion disposed within said external field;

a field shaping portion; and a flux channelling arm connecting said flux collecting portion and said field shaping portion comprising a member having an orientation such that the eddy currents generated by the flux of said electromagnetic field of said line-rate deflection winding that enters said flux channelling arm is small due to said orientation.

5. The arrangement defined in claim 4, wherein said orientation comprises the edge of said flux channelling member being perpendicular to the lines of said flux of said line-rate electromagnetic field.

6. A deflection yoke for a cathode ray tube of a video apparatus comprising:

a line-rate deflection winding producing an electromagnetic field;

a field-rate deflection winding incorporating end turns, said winding producing an electron beam deflection field and an external field; and first and second magnetically permeable field modifying members disposed on opposite sides of said deflection yoke for producing an auxiliary electron beam deflection field, each of said members comprising:

a first flux collecting portion disposed within said external field;

a field shaping portion; and a flux channelling arm comprising a thin member connecting said flux collecting portion and said field shaping portion and passing through said line-rate deflection winding electromagnetic field, said flux channelling arm oriented on edge rather than flat such that the flux lines of said electromagnetic field of said line-rate deflection winding intersect said edge of said flux channelling arm rather than said flat.

* * * * *